US006722867B2

(12) United States Patent
Murata

(10) Patent No.: US 6,722,867 B2
(45) Date of Patent: Apr. 20, 2004

(54) ROTARY COMPRESSOR FOR VEHICLE

(75) Inventor: Nakato Murata, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/368,352

(22) Filed: Feb. 20, 2003

(65) Prior Publication Data

US 2003/0180169 A1 Sep. 25, 2003

(30) Foreign Application Priority Data

Mar. 19, 2002 (JP) ..... 2002-076194

(51) Int. Cl.[7] ..... F01C 21/00

(52) U.S. Cl. ..... 418/69; 418/40; 418/42; 74/822

(58) Field of Search ..... 418/69, 40, 42; 74/822

(56) References Cited

U.S. PATENT DOCUMENTS 2,330,565 A * 9/1943 Eckart ..... 418/260
2,380,873 A * 7/1945 Schafer et al. ..... 74/822
2,688,924 A * 9/1954 Links ..... 418/266
4,828,463 A * 5/1989 Nishizawa et al. ..... 418/69
6,135,740 A * 10/2000 Hult et al. ..... 418/69

FOREIGN PATENT DOCUMENTS

JP A 56-138488 10/1981
JP A 61-118578 6/1986

* cited by examiner

*Primary Examiner*—Thomas Denion
*Assistant Examiner*—Theresa Trieu
(74) *Attorney, Agent, or Firm*—Oliff & Berridge, PLC

(57) ABSTRACT

A rotary compressor includes a rotor rotatably disposed to be eccentric to an inner peripheral surface of a housing, a rotation shaft for transmitting rotation force of an engine to the rotor, and a connection member through which the rotation shaft is connected to the rotor so that the rotation force is transmitted from the rotation shaft to the rotor. When a rotation speed of the rotation shaft is lower than a predetermined valve, the connection member is connected to the rotation shafts at the rotation force of the rotation shaft that is transmitted to the rotor. On the other hand, when the rotation speed of the rotation shaft is equal to or higher than the predetermined value, the rotation force from the rotation shaft to the rotor is interrupted, so that the rotary compressor is stopped. Therefore, useless load applied to the engine can be restricted.

19 Claims, 4 Drawing Sheets

ROTARY COMPRESSOR FOR VEHICLE

CROSS REFERENCE TO RELATED APPLICATION

This application is based on Japanese Patent Application No. 2002-76194 filed on Mar. 19, 2002, the disclosure of which is incorporated herein by reference.

BACKGROUND OF THE INVENTION

1. Field of the Invention

The present invention relates to a rotary compressor for a vehicle. The rotary compressor is suitably used for a vacuum pump driven by an engine, or a power pump mounted on a power steering device for a vehicle.

2. Related Art

As shown in FIGS. 3 and 4, a rotary compressor 101 includes a housing 102, a rotation shaft 103, a rotor 104 and vanes 105. The housing 102 is arranged adjacent to an AC generator (not shown). An intake port 106 is provided at an upper side of the housing 102, and a discharge port 107 is provided at a lower side of the housing 102. The rotation shaft 103 extends from a front frame of the AC generator into the housing 102 to be used also as a rotation shaft of the AC generator. As shown in FIG. 4, vane recesses 140 extending radially are provided in an outer peripheral surface of the rotor 104, and the vanes 105 are disposed to be movably held in the vane recesses 140. On the other hand, the rotation shaft 103 is coupled to an engine through a V-belt and a pulley, on the side of the AC generator. Therefore, in a case where the rotation speed of the engine is high, such as in a vehicle travelling on a speedway, the rotation speed of the rotation shaft 103 becomes higher. Conversely, in a case where the rotation speed of the engine is low, such as in a vehicle travelling on an urban road, the rotation speed of the rotation shaft 103 becomes lower. On the other hand, when the vehicle is traveling in the urban road, the using frequency of a brake connected to the rotary compressor 101 becomes higher as compared with the case where the vehicle is traveling in the speedway. However, in the rotary compressor 101, the rotor 104 is integrally connected to the rotation shaft 103. Accordingly, when the rotation speed of the engine is high, the rotor 104 always rotates so that a sufficient negative pressure (vacuum) is applied. That is, useless rotation is performed in the rotor 104. Therefore, load applied to the engine is increased, and fuel consumption efficiency of the vehicle is deteriorated.

Further, in the high-rotation speed of the engine, the rotation speed of the rotor 104 is high as compared with that in the low-rotation speed of the engine. Therefore, sliding members of the rotary compressor 101 are required to have resistant to attrition, friction heat and centrifugal force, due to the high-speed rotation.

On the other hand, if the rotary compressor 101 is used for a power steering device, when the rotation speed of the engine is low, the using frequency of a vehicle steering is higher as compared with a case where the rotation speed of the engine is high. Accordingly, even when the rotary compressor 101 is used for the power pump of the power steering device, the problems described above in the vacuum pump may be caused.

SUMMARY OF THE INVENTION

In view of the above-described problems, it is an object of the present invention to provide a vehicle rotary compressor operated by a driving source, which can effectively restrict useless rotation in a high-speed rotation of the driving source.

It is another object of the present invention to provide a vehicle rotary compressor that can reduces a request of durability in slidable members.

According to the present invention, in a rotary compressor for a vehicle includes a housing having an approximate cylindrical inner peripheral surface, a rotor that is rotatable eccentrically to the inner peripheral surface of the housing, a plurality of vanes disposed radially in an outer peripheral surface of the rotor to be slidable on the inner peripheral surface of the housing, a rotation shaft that is disposed to transmit a rotation force of a driving source to the rotor, and a connection member that is disposed to be connected to the rotation shaft and the rotor such that the rotation force of the rotation shaft is transmitted to the rotor. In the rotary compressor, the connection member is connected to the rotation shaft so that the rotation force is transmitted from the rotation shaft to the rotor when a rotation speed of the rotation shaft is lower than a predetermined value, and the connection member is separated from the rotation shaft so that the rotation force from the rotation shaft to the rotor is interrupted when the rotation speed of the rotation shaft is equal to or higher than the predetermined value. Accordingly, when the rotation speed of the rotation shaft is equal to or higher than the predetermined value, the operation of the rotary compressor is stopped. Therefore, it can restrict useless load from being applied to the engine, and fuel consumption efficiency can be improved. Further, the rotary compressor does not rotate with a high rotation speed. Therefore, slidable members of the rotary compressor are unnecessary to have durability to attrition, fraction heat and centrifugal force, due to the high-rotation speed. Here, the sladable members include at least the housing, the rotor and the vanes. Accordingly, materials for forming the rotary compressor can be readily selected.

According to the present invention, a biasing member for biasing the connection member toward the rotation shaft is provided, and the rotor has a receiving portion for receiving the connection member and the biasing member. Therefore, when the rotation speed of the rotation shaft is lower than the predetermined value, the connection member is biased toward the rotation shaft by the biasing force of the biasing member, and the connection member can be connected to the rotation shaft. Thus, the rotary compressor can be operated. On the other hand, when the rotation speed of the rotation shaft is equal to or higher than the predetermined value, centrifugal force applied to the connection member becomes larger than the biasing force of the biasing member. Therefore, the connection between the connection member and the rotation shaft is interrupted, and the operation of the compressor is stopped. Because a rotation transmission mechanism of the rotary compressor is constructed by the balance between the centrifugal force and the biasing force of the biasing member, the rotation transmission mechanism has a simple structure. Thus, the number of the rotary compressor can be reduced while reliability thereof can be improved.

Preferably, the rotation shaft has thereon a connection portion having an engagement portion, and the engagement portion is provided to be engaged with the connection member in a rotation direction of the rotation shaft so that the rotation force of the rotation shaft is transmitted to the rotor. Therefore, the rotation force of the rotation shaft can be transmitted to the rotor by the engagement between the connection member and the engagement portion provided on the rotation shaft. Further, the connection portion is provided on the rotation shaft such that a distance "r" between a center of the rotation shaft to the connection portion is gradually increased in the rotation direction of the rotation shaft. Therefore, it can effectively restrict a large collision from being caused between the connection member and the connection portion of the rotation shaft when the rotation speed of the rotation shaft is changed from a speed higher than the predetermined value to a speed lower than the predetermined speed.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENT

A preferred embodiment of the present invention will be now described with reference to FIGS. 1 and 2.

In this embodiment, a rotary compressor 1 for a vehicle is typically used for a vacuum pump for driving a master cylinder for a vehicle brake. The rotary compressor 1 is driven by an engine, and is connected to an AC generator for the vehicle.

Figure 1:
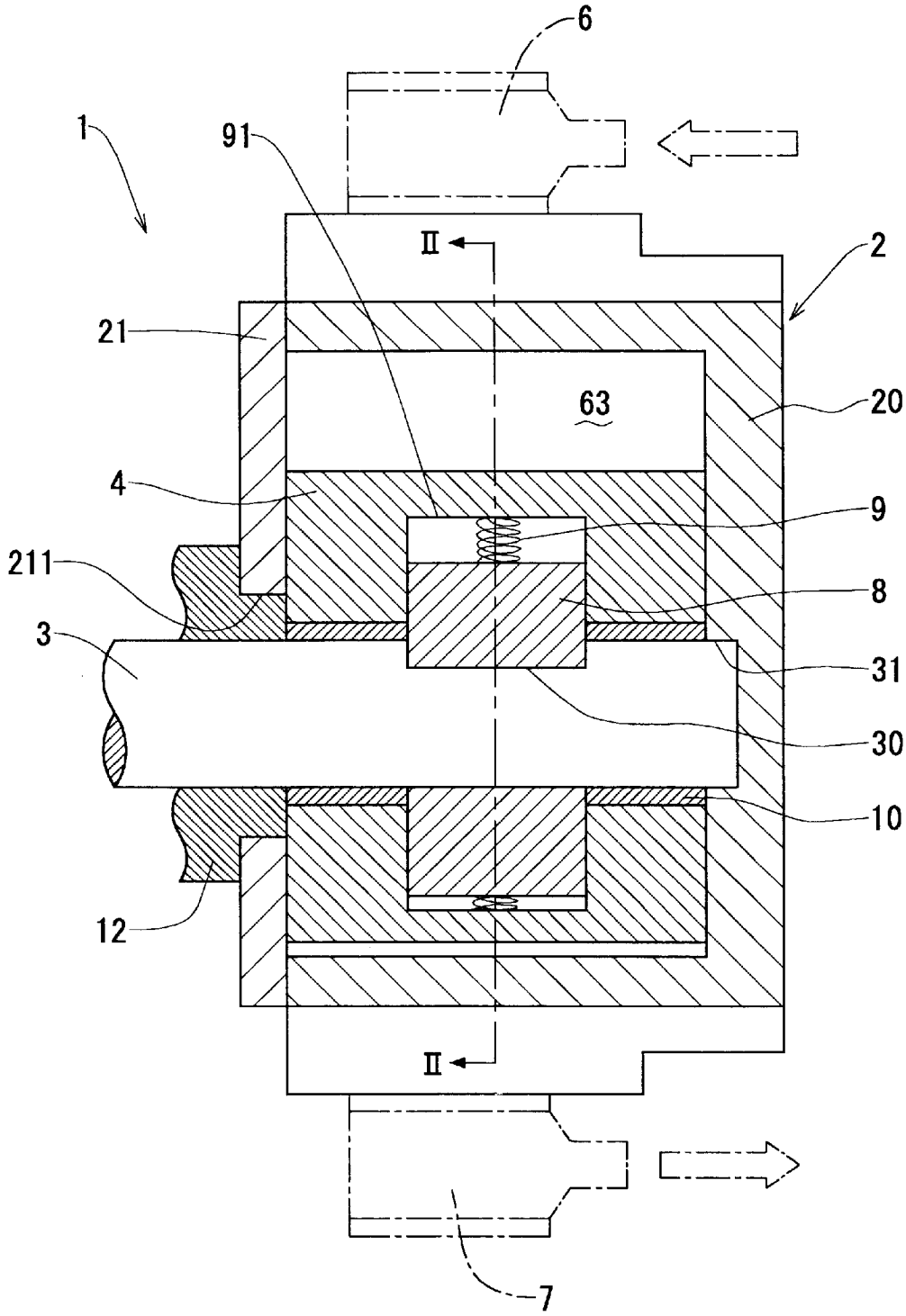
FIG. 1 is a sectional view in an axial direction, showing a rotary compressor for a vehicle, according to a preferred embodiment of the present invention.
Figure 2:
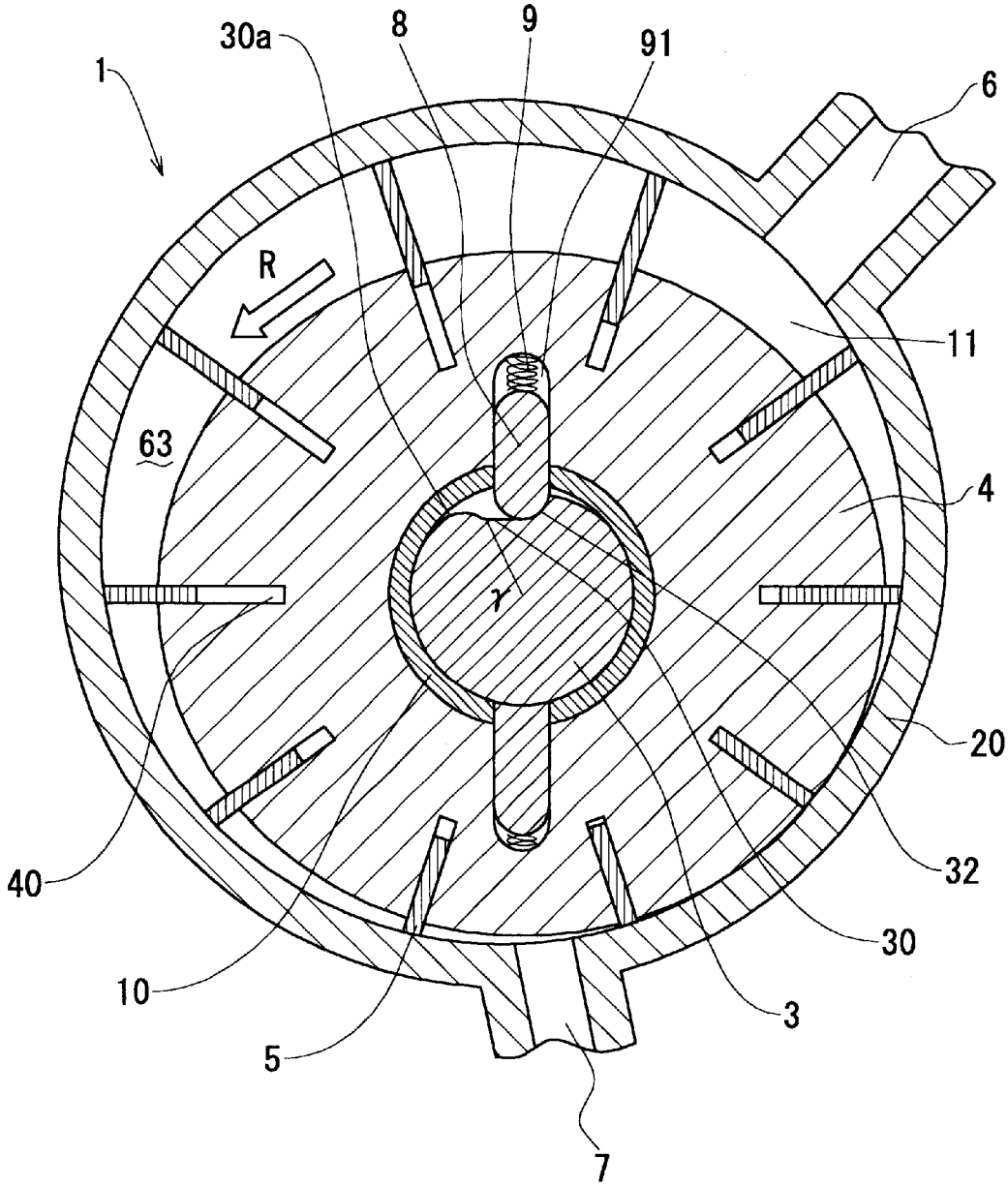
FIG. 2 is a cross-sectional view taken along line II—II in FIG. 1.
Figure 3:
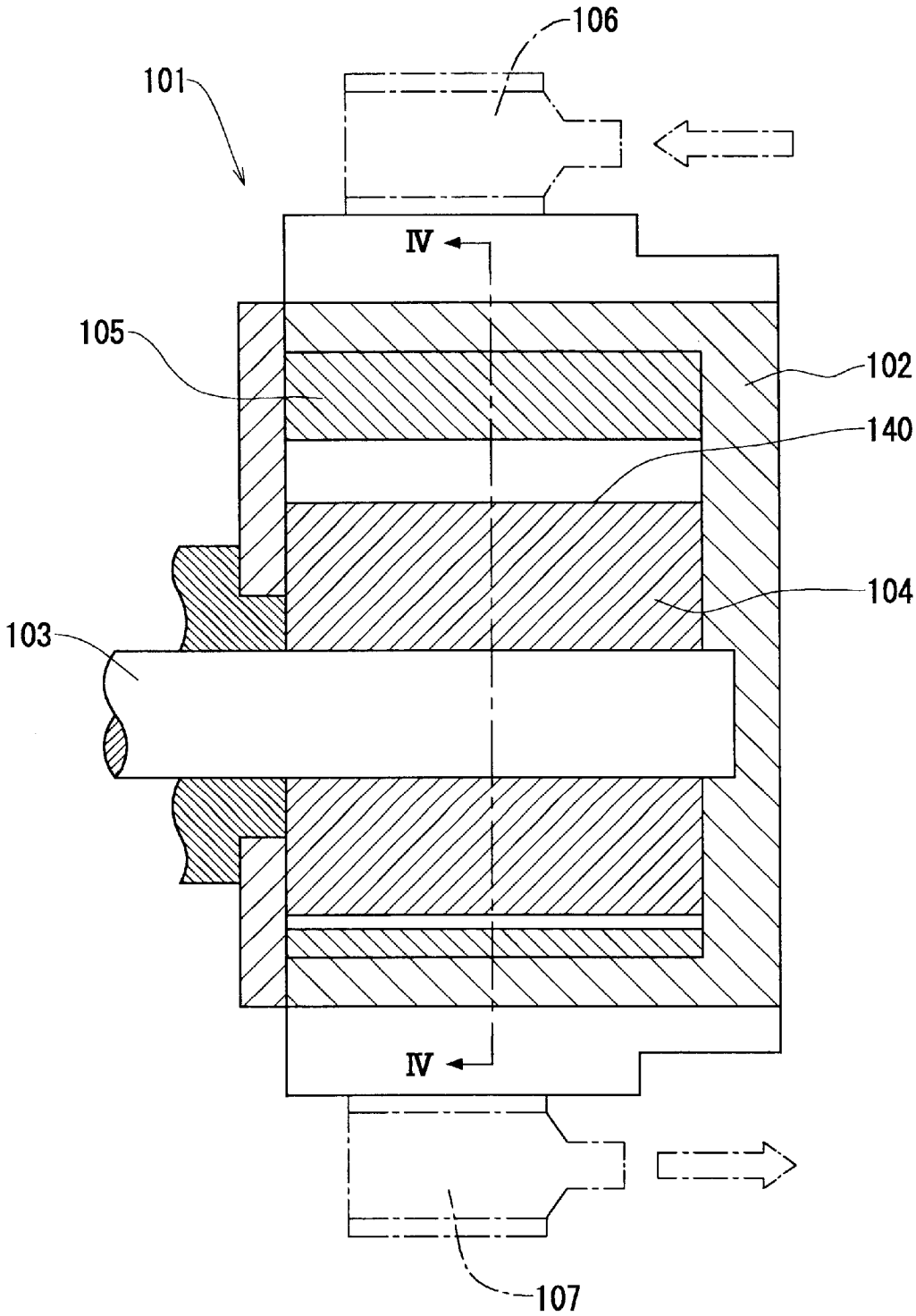
FIG. 3 RELATED ART
FIG. 3 is a sectional view in an axial direction, showing a rotary compressor for a vehicle, in a related art.
Figure 4:
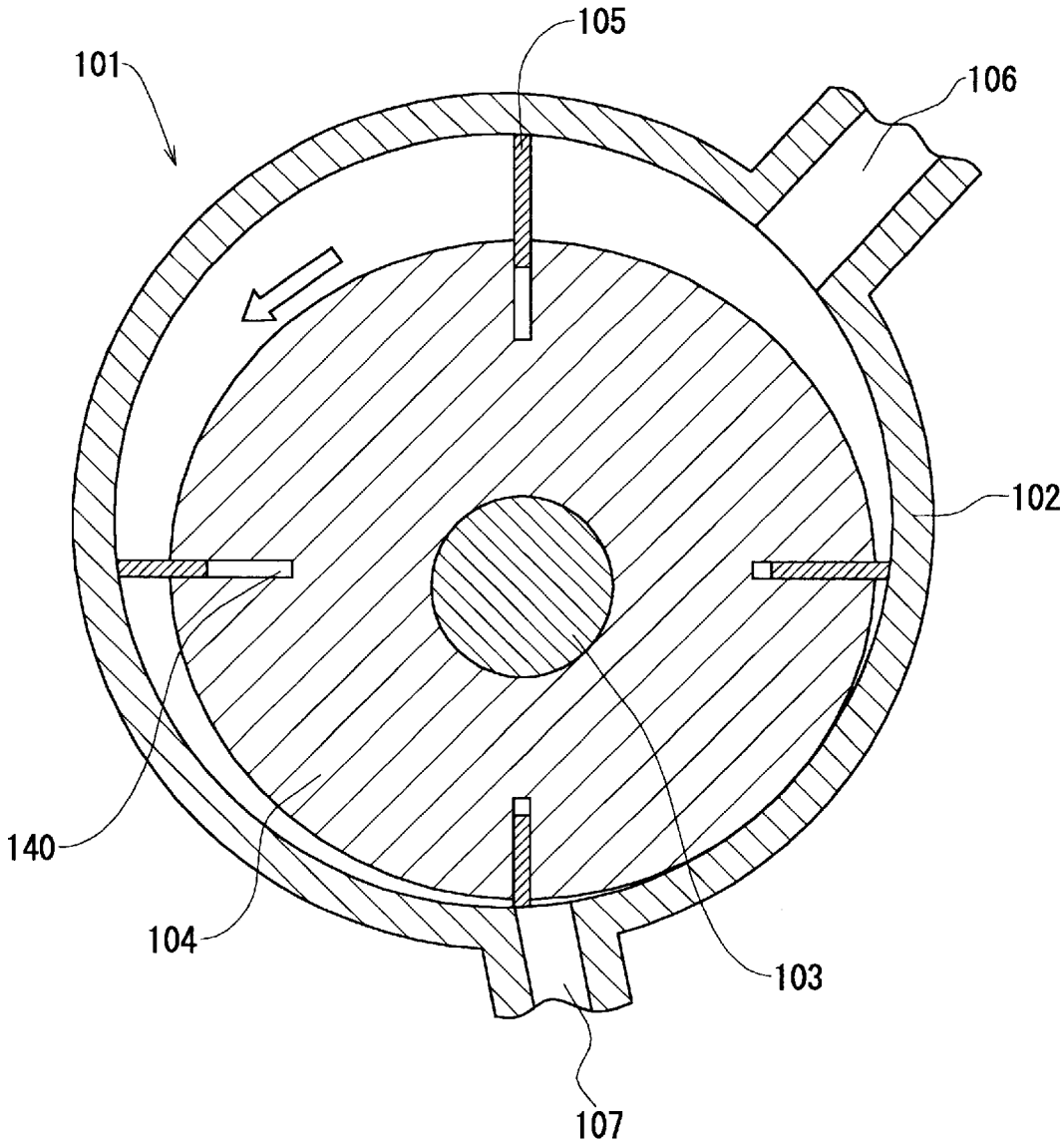
FIG. 4 RELATED ART
FIG. 4 is a cross-sectional view taken along line IV—IV in FIG. 3.

As shown in FIG. 1, the rotary compressor 1 includes a housing 2, a rotation shaft 3, a rotor 4, vanes 5 and a driving transmission vane 8. The housing 2, for accommodating components of the rotary compressor 1, is constructed of a front frame 20 and a rear frame 21. The front frame 20 is made of an aluminum alloy, and is formed into a cylindrical shape having a closed bottom portion. Specifically, the front frame 20 has a cup shape which is opened toward the rear frame 21. An intake port 6 is provided to protrude from an upper peripheral surface of the front frame 20, as shown in FIG. 1. The intake port 6 is provided to communicate with a vacuum tank for supplying to the vacuum (negative pressure) to a vacuum brake booster. On the other hand, a discharge port 7 is provided to protrude from a lower peripheral surface of the front frame 20, as shown in FIG. 1.

The rear frame 21 is made of aluminum, and is formed into a ring shape. For example, the rear frame 21 is disposed at a left side of the front frame in FIG. 1. Further, an AC generator (not shown) is disposed at a side of the rear frame 21 to be opposite to the front frame 20. An insertion port 211 penetrating through the rear frame 21 is provided in the rear frame 211 at a position offset from a center. A boss portion 12 of the AC generator is inserted into the insertion port 211 from the side opposite to the front frame 20.

The rotation shaft 3 is made of a steel material, and is provided to extend from an inside of a front frame of the AC generator. The rotation shaft 3 is inserted into the housing 2 to be rotatable through an inner peripheral surface of the boss portion 12. Further, as shown in FIG. 2, a driving transmission vane recess 30 is provided on the outer periphery of the rotation shaft 3, for engaging with the driving transmission vane 8 that is used as a connection member. The vane recess 30 includes an engagement portion 32 that is engaged with the driving transmission vane 8 to transmit the rotation force of the rotation shaft 3 to the rotor 4. Further, the vane recess 30 is provided such that a distance "r" between the center of the rotation shaft 3 to the vane recess 30 is gradually increased in the rotation direction of the rotation shaft 3. Further, an end portion of the vane recess 30 in the rotation direction of the rotation shaft 3 is positioned to have the same radius as the rotation shaft 3. The end portion of the vane recess 30 is formed to have a smooth curve surface. The rotation shaft 3 is held rotatably by a bearing of the AC generator of the vehicle.

The rotor 4 is made of an iron group metal, and is formed into a cylinder shape. The rotor 4 is provided with a cylinder-shaped metal bearing 10 on its inner peripheral side. The metal bearing 10 is disposed to rotatably support the rotation shaft 3 that is disposed on an inner peripheral surface of the rotor 4 by insert-molding. As shown in FIG. 2, ten vane recesses 40 are provided radially to be separated from each other in a circumference direction by 36 degrees. Further, at an inner peripheral side of the rotor 4, two spring-receiving grooves 91 extending radially are formed in the rotor 4 to be separated by 180 degrees.

Each of the vanes 5 is made of carbon, and is formed into a rectangular shape. Inner radial end portions of the vanes 5 are accommodated in the vane recesses 40 to be slidable. On the other hand, outer radial ends of the vanes 5 contact an inner peripheral surface of the front frame 20 by centrifugal force generated in the rotation of the rotation shaft 3.

The driving transmission vane 8 is made of a steel that is harder than the rotation shaft 3, and is formed into approximate rectangular parallelopiped shape having round two ends in the radial direction. As shown in FIG. 2, in this embodiment, two driving transmission vanes 8 are provided to be separated by 180 degrees in the circumference direction, so that heat-treatment strength and collision resistance of the driving transmission vane 8 can be improved. Further, the driving transmission vane 8 is engaged with the engagement portion 32 to be movable in the vane recess 30 in the radial direction. One end of the driving transmission vane 8 contacts a spring 9 disposed in the spring-receiving groove 91 at a radial end to be biased toward radial inside.

Next, operation of the rotary compressor 1 according to this embodiment will be now described. The rotation shaft 3 is rotated by driving of the engine. When the rotation speed of the rotation shaft 3 is equal to or lower than a predetermined value, the rotation force of the rotation shaft 3 is transmitted to the rotor 4 through the vanes 8, so that the rotor 4 rotates by the transmitted rotation force. When the rotor 4 rotates, the vanes 5 protrude from the vane recesses 40 by the centrifugal force, and the vanes 5 rotates while slidably contacting the inner peripheral surface of the front frame 20. When the vanes 5 contact the inner peripheral surface of the front frame 20, a space 11 between the rotor 4 and the inner peripheral surface of the front frame 20 is partitioned into ten pump chambers 63. That is, the ten pump chambers 63 partitioned from each other are defined by the inner peripheral surface of the housing 2, the outer peripheral surface of the rotor 4 and the vanes 5. The pump chambers 63 are rotated as shown by the arrow R in FIG. 2.

The pump chambers 63 rotate while changing its volumes. The pump chambers 63 communicate with the intake port 6 in a volume increasing operation, and communicate with the discharge port 7 in a volume decreasing operation.

In the volume increasing operation of the pump chambers 63, air is sucked from the intake port 60 into the pump chambers 63. Therefore, the volume increasing operation is a suction stroke. The sucked air is gradually compressed in the volume decreasing operation that is a compression stroke. At an end time of the compression stroke, the compressed air is discharged from the discharge port 7. That is, the compressed air is discharged from the discharge port 7 in a discharge stroke. Accordingly, when the rotation speed of the rotation shaft 3 is lower than the predetermined value, the suction stroke, the compression stroke and the discharge stroke are repeated with the rotation of the rotor 4. Therefore, the rotary compressor 1 supplies vacuum to the vacuum brake booster.

On the other hand, when the rotation speed of the rotation shaft 3 is equal to or higher than the predetermined value, the centrifugal force applied to the driving transmission vane 8 becomes larger. Therefore, the centrifugal force applied to the driving transmission vane 8 becomes larger than the pressing force of the spring 9, and the spring 9 is pressed to radial outside. Thus, as the rotation speed of the rotation shaft becomes higher, the driving transmission vane 8 more moves radial outside. Then, when the rotation speed of the rotation shaft 3 increases to the predetermined value, the engagement between the driving transmission vane 8 and the rotation shaft 3 is interrupted, and the transmission of the rotation force from the rotation shaft 3 to the rotor 4 is interrupted. In this case, the operation of the rotary compressor 1 is stopped.

Further, as the rotation speed of the rotation shaft 3 reduces, the centrifugal force applied to the driving transmission vane 8 is gradually reduced. Therefore, the driving transmission vane 8 moves radial inside by the pressing force of the spring 9. When the rotation speed of the rotation shaft 3 is reduced to the predetermined value, the driving transmission vane 8 re-engages with the vane recess 30 of the rotation shaft 3. Therefore, the rotation force of the rotation shaft 3 is transmitted to the rotor 4, and the rotary compressor 1 operates.

According to the present embodiment, the rotary compressor 1 stops when the rotation speed is higher than the predetermined value where the using frequency of the brake is reduced. Therefore, it can restrict an useless engine lode, and fuel consumption efficiency in the vehicle can be improved. Further, the rotor 4 of the rotary compressor 1 does not rotate at a high speed. Therefore, the housing 2, the rotor 4 and the vanes 5 of the rotary compressor 1 are unnecessary to improve resistance to attrition, friction heat and centrifugal force, due to the high-speed rotation. Thus, material selection for the components for constructing the rotary compressor 1 can be readily performed. Further, a rotation transmission mechanism of the rotary compressor 1 is constructed with the balance between the centrifugal force and the pressing force of the spring 9. Therefore, the structure of the rotation transmission mechanism of the rotary compressor 1 can be made simple. Accordingly, in the rotary compressor 1 of the present embodiment, the component number can be reduced, and product cost can be reduced, as compared with a rotary compressor that uses a rotary transmission mechanism with an electronic control.

In the rotary compressor 1 of this embodiment, the rotation shaft 3 and the rotor 4 are held through the metal bearing 10. That is, the rotation shaft 3 and the rotor 4 are not directly connected to each other. Therefore, it is possible to interrupt the transmission of the rotation force of the rotation shaft 3 to the rotor 4 when the rotation speed of the rotation shaft 3 is higher than the predetermined value. Thus, when the rotation speed of the rotation shaft 3 is higher than the predetermined value, load is not applied to a driving source such as the engine. In the present embodiment, the rear end of the rotation shaft 3 of the AC generator can be directly used as the rotor insertion portion 31 in the rotary compressor 1. Therefore, it is unnecessary to provide the rotation shaft 3 newly only for the rotary compressor 1. Thus, the component number can be effectively reduced in the rotary compressor 1.

Further, the driving transmission vane recess 30 has the engagement portion 32, and the driving transmission vane 8 is engaged with the engagement portion 32 in the rotation direction of the rotation shaft 3, so that the rotation force of the rotation shaft 3 is transmitted to the rotor 4 through the driving transmission vane 8. Further, the distance "r" from the center of the rotation shaft 3 to the vane recess 30 is gradually increased in the rotation direction of the rotation shaft 3. Accordingly, when the rotation speed of the rotation shaft 3 decreases from a speed higher than the predetermined value to a speed lower than the predetermined value so that the driving transmission vane 8 is engaged with the driving transmission vane recess 30 formed in the rotation shaft 3, it can restrict a large collision from being generated between the driving transmission vane 8 and the vane recess 30 of the rotation shaft 3. Thus, it can effectively restrict the driving transmission vane 8 and the vane recess 30 of the rotation shaft 3 from being damaged.

Further, the end 30*a* of the vane recess 30 in the rotation direction of the rotation shaft 3 is positioned to have the same radius as the rotation shaft 3. Accordingly, when the rotation speed of the rotation shaft 3 changes from a speed higher than the predetermined value to a speed lower than the predetermined value so that the driving transmission vane 8 is engaged with the driving transmission vane recess 30 formed in the rotation shaft 3, it can restrict a large collision from being generated between the driving transmission vane 8 and the vane recess 30. In addition, the end 30*a* of the vane recess 30 in the rotation direction of the rotation shaft 3 is provided to have a smoothly curved surface. Accordingly, the collision generated between the driving transmission vane 8 and the vane recess 30 can be effectively reduced. Therefore, it can further restrict the driving transmission vane 8 and the vane recess 30 from being damaged.

Although the present invention has been fully described in connection with the preferred embodiment thereof with reference to the accompanying drawings, it is to be noted that various changes and modifications will become apparent to those skilled in the art.

For example, in the above-described embodiment, the rotary compressor 1 is typically used for the vacuum pump with the AC generator. However, the rotary compressor 1 can be used for a power steering pump for an electrical power steering device.

In the above-described embodiment, the metal bearing 10 is provided on the inner peripheral surface of the rotor 4. However, the other bearings such as a ball bearing can be used for holding the position of the rotor 4 with the rotation shaft 3.

In the above-described embodiment, the two driving transmission vanes 8 and the two spring-receiving recesses 91 are provided opposite to each other. However, the number of the driving transmission vanes 8 can be freely set in accordance with the rotation speed of the driving source such as the engine. Preferably, even number of the driving transmission vanes 8 and the spring-receiving grooves 91 are provided uniformly in the circumference direction. In this case, the balance of the rotor 4 can be improved. The number of the vanes 5 can be changed similarly.

Such changes and modifications are to be understood as being within the scope of the present invention as defined by the appended claims.

What is claimed is:

1. A rotary compressor for a vehicle, comprising:

a housing having an approximate cylindrical inner peripheral surface;

a rotor that is rotatable eccentrically to the inner peripheral surface of the housing;

a plurality of vanes disposed radially in an outer peripheral surface of the rotor to be slidable on the inner peripheral surface of the housing;

a rotation shaft that is disposed to transmit rotation force of a driving source to the rotor; and a connection member that is disposed to be connected to the rotation shaft and the rotor such that the rotation force of the rotation shaft is transmitted to the rotor, wherein:

the connection member is connected to the rotation shaft so that the rotation force is transmitted from the rotation shaft to the rotor, when a rotation speed of the rotation shaft is lower than a predetermined value; and the connection member is separated from the rotation shaft so that the rotation force from the rotation shaft to the rotor is interrupted, when the rotation speed of the rotation shaft is equal to or higher than the predetermined value.

2. The rotary compressor according to claim 1, further comprising a biasing member for biasing the connection member toward the rotation shaft, wherein the rotor has a receiving portion for receiving the connection member and the biasing member.

3. The rotary compressor according to claim 1, wherein the rotation shaft is disposed at an inner radial side of the rotor, the rotary compressor further comprising a biasing member for biasing the connection member to a radial inside, wherein the rotor has a receiving portion for receiving the connection member and the biasing member.

4. The rotary compressor according to claim 3, wherein the biasing member is movable in the receiving portion to transmit and interrupt the rotation force from the rotation shaft to the rotor.

5. The rotary compressor according to claim 1, further comprising a rotation holding member, provided on an inner peripheral surface of the rotor, for rotatably supporting the rotation shaft.

6. The rotary compressor according to claim 1, wherein:

the rotation shaft has thereon a connection portion having an engagement portion; and the engagement portion is provided to be engaged with the connection member in a rotation direction of the rotation shaft so that the rotation force of the rotation shaft is transmitted to the rotor.

7. The rotary compressor according to claim 6, wherein the connection portion is provided on the rotation shaft such that a distance "r" between a center of the rotation shaft to the connection portion is gradually increased in the rotation direction of the rotation shaft.

8. The rotary compressor according to claim 7, wherein the distance between the center of the rotation shaft and an end of the connection portion in the rotation direction of the rotation shaft is equal to an inner radius of the rotation shaft.

9. The rotary compressor according to claim 8, wherein the end of the connection portion in the rotation direction of the rotation shaft is provided to be smoothly curved.

10. The rotary compressor according to claim 1, wherein the connection member has a hardness that is harder than that of the rotation shaft.

11. The rotary compressor according to claim 2, wherein the biasing member is a spring.

12. A rotary compressor for a vehicle, comprising:

a housing having an approximate cylindrical inner peripheral surface;

a rotor that is rotatable eccentrically to the inner peripheral surface of the housing;

a plurality of vanes disposed radially in an outer peripheral surface of the rotor to be slidable on the inner peripheral surface of the housing;

a rotation shaft that is disposed radial inside of the rotor to transmit rotation force of a driving source to the rotor;

a connection member that is disposed to be connected to the rotation shaft and the rotor such that the rotation force of the rotation shaft is transmitted to the rotor; and a biasing member for biasing the connection member radially inside toward the rotation shaft, wherein:

the rotor has a receiving portion for receiving the connection member and the biasing member; and the connection portion is movable in the receiving portion to transmit and interrupt the rotation force from the rotation shaft to the rotor.

13. The rotary compressor according to claim 12, further comprising a rotation holding member, provided on an inner peripheral surface of the rotor, for rotatably supporting the rotation shaft.

14. The rotary compressor according to claim 12, wherein:

the rotation shaft has thereon a connection portion having an engagement portion; and the engagement portion is provided to be engaged with the connection member in a rotation direction of the rotation shaft so that the rotation force of the rotation shaft is transmitted to the rotor.

15. The rotary compressor according to claim 14, wherein the connection portion is provided on the rotation shaft such that a distance "r" between a center of the rotation shaft to the connection portion is gradually increased in the rotation direction of the rotation shaft.

16. The rotary compressor according to claim 15, wherein the distance between the center of the rotation shaft and an end of the connection portion in the rotation direction of the rotation shaft is equal to an inner radius of the rotation shaft.

17. The rotary compressor according to claim 16, wherein the end of the connection portion in the rotation direction of the rotation shaft is provided to be smoothly curved.

18. The rotary compressor according to claim 12, wherein the connection member has a hardness that is harder than that of the rotation shaft.

19. The rotary compressor according to claim 12, wherein the biasing member is a spring.

* * * * *